US008469484B2

(12) United States Patent
Jogo et al.

(10) Patent No.: US 8,469,484 B2
(45) Date of Patent: Jun. 25, 2013

(54) INKJET APPARATUS AND METHOD FOR JUDGING REPLACEMENT TIMING FOR COMPONENTS OF THE APPARATUS

(75) Inventors: Jumpei Jogo, Kawasaki (JP); Yutaka Kawamata, Koganei (JP); Kazuo Suzuki, Yokohama (JP); Toshimitsu Danzuka, Tokyo (JP); Masataka Kato, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 13/162,143

(22) Filed: Jun. 16, 2011

(65) Prior Publication Data

US 2011/0310160 A1 Dec. 22, 2011

(30) Foreign Application Priority Data

Jun. 22, 2010 (JP) ..... 2010-141657

(51) Int. Cl.
*B41J 29/393* (2006.01)

(52) U.S. Cl.
USPC ..... 347/19

(58) Field of Classification Search
CPC ..... B41J 2/1652
USPC ..... 347/6, 7, 19–21
See application file for complete search history.

(56) References Cited

U.S. PATENT DOCUMENTS

| | | | | |
|---|---|---|---|---|
| 6,264,320 | B1 | 7/2001 | Moriyama et al. | |
| 6,412,934 | B1 | 7/2002 | Moriyama et al. | |
| 6,582,047 | B2 * | 6/2003 | Koitabashi et al. | 347/16 |
| 6,834,947 | B2 | 12/2004 | Moriyama et al. | |
| 7,543,899 | B2 * | 6/2009 | Konno | 347/6 |
| 2009/0021548 | A1 | 1/2009 | Suzuki et al. | |

FOREIGN PATENT DOCUMENTS

JP 11-240165 A 9/1999

OTHER PUBLICATIONS

U.S. Appl. No. 13/160,787, filed Jun. 15, 2010.

* cited by examiner

*Primary Examiner* — An Do
(74) *Attorney, Agent, or Firm* — Fitzpatrick, Cella, Harper & Scinto

(57) ABSTRACT

In an inkjet apparatus capable of ejecting an ink and a treatment liquid for insolubilizing or coagulating a color material in the ink, a replacement timing for a component of the apparatus is judged based on both the consumption amounts of the ink and treatment liquid measured when the two are consumed together and the consumption amount of the ink measured when the ink is consumed alone. Thus, the component is replaced at an earlier timing when the influence of fixed adhesion is great due to frequent ejection of both of the ink and treatment liquid, which prevents fixed adhesion from influencing the print performance and the printing apparatus main body. By contrast, when the fixed adhesion slowly develops because of less-frequent ejection of both of the ink and treatment liquid, the component is replaced at a later timing and thus can be used until reaching its lifetime.

10 Claims, 8 Drawing Sheets

| DOT COUNT WEIGHTING REGARDING LIFETIME OF COMPONENT TO BE REPLACED DUE TO MIST INFLUENCE | DOT COUNT WEIGHTING FOR TREATMENT LIQUID | DOT COUNT WEIGHTING FOR INK |
|---|---|---|
| WHEN TREATMENT LIQUID IS USED | 1.15 | 1 |
| WHEN TREATMENT LIQUID IS NOT USED | 0 | 0.75 |

FIG.6

| LIQUID-AMOUNT COUNT WEIGHTING REGARDING LIFETIME OF COMPONENT TO BE REPLACED DUE TO CONSUMED LIQUID INFLUENCE | LIQUID-AMOUNT COUNT WEIGHTING FOR TREATMENT LIQUID | LIQUID-AMOUNT COUNT WEIGHTING FOR INK |
|---|---|---|
| WHEN TREATMENT LIQUID IS USED | 1.15 | 1 |
| WHEN TREATMENT LIQUID IS NOT USED | 0 | 0.75 |

FIG.8

INKJET APPARATUS AND METHOD FOR JUDGING REPLACEMENT TIMING FOR COMPONENTS OF THE APPARATUS

BACKGROUND OF THE INVENTION

1. Field of the Invention

The present invention relates to an inkjet apparatus capable of ejecting an ink and a treatment liquid for insolubilizing or coagulating a color material in the ink; and a method for judging replacement timings for components constituting the apparatus.

2. Description of the Related Art

When ejecting a liquid from a print head, droplets (hereinafter, also called a mist) each smaller than a main droplet are also generated in an inkjet apparatus. In this case, for example, a so-called serial printing apparatus suffers from a phenomenon that the mist adheres, for example, to a face (hereinafter, also called an ejection face) of an inkjet head provided with ejection openings due to influences of an air current generated by the movement of the inkjet head, an air current generated by the ejection of the main droplet, or other causes. Even if two or more kinds of ink mists that do not react with each other adhere to the ejection face, fixed adhesion of the ink mists due to a reaction does not occur; or otherwise, the degree of adhesion is negligible, if any. However, in the case of an ink mist and a mist of a treatment liquid, the ink mist and the mist of the treatment liquid react with each other on the ejection face, and thus the mists fixedly adhere thereto. Particularly, the fixed adhesion of the mists to a portion near the ejection openings may cause a phenomenon such as ejection failure or deflection of the ejection direction from an appropriate direction. Consequently, undesirable lines, unevenness, or the like may be generated in outputted images to deteriorate the image quality.

Against such problems, Japanese Patent Laid-Open No. H11-240165 (1999) has made a proposal as follows. Specifically, the number of ejected dots is counted (i.e., 'dot count' is performed) for each of inkjet heads for the respective color inks. In addition, for each ink color, a smaller value is determined as a threshold value as the possibility of adhesion of the ink and the treatment liquid to the corresponding inkjet head is higher. Then, when the count value exceeds the threshold value, a recovery operation such as wiping is performed at least on the inkjet head of the ink color in question. Thereby, an appropriate recovery operation such as wiping can be performed in accordance with the amount of mist adhering to the inkjet head. This makes it possible to prevent fixed adhesion near nozzles of the inkjet head.

However, a mist does not adhere only to an ejection face. While floating in an air current within a printing apparatus, a mist may adhere also to components constituting the apparatus such as a mechanism for moving a print medium and an inkjet head relative to each other, a mechanism for performing the above recovery operation, and a sensor for performing a desired detection for a printing operation. In other words, the problem of fixed adhesion by a reaction between the ink and the treatment liquid may occur not only on the inkjet head but also on components constituting a printing apparatus. As the fixed adhesion develops, the performance of each component is reduced, and the performance of the printing apparatus main body cannot be maintained in the end. For this reason, it is necessary to know how much the fixed adhesion on each of these components in the apparatus main body is developed and to make a maintenance such as replacement of the component when it is estimated that the component performance is reduced to such an extent that the performance of the printing apparatus main body cannot be maintained.

The technique disclosed in Japanese Patent Laid-Open No. H 11-240165 (1999), however, is made only for a recovery operation to prevent fixed adhesion on ejection faces of the inkjet heads of the respective colors, but is not made in consideration of fixed adhesion on other components within the main body. Meanwhile, in fact, a condition of fixed adhesion to the inkjet head and the other components within the main body as well as a timing for a maintenance such as replacement of a component are different between a case where the treatment liquid and ink are used together and a case where the ink is used alone. Nevertheless, Japanese Patent Laid-Open No. H 11-240165 (1999) only focuses on the recovery operation for preventing fixed adhesion on the ejection faces of inkjet heads of the respective colors, but does not take the above point into consideration as well.

SUMMARY OF THE INVENTION

In view of the above-described problems, an object of the present invention is to replace components within an inkjet apparatus main body at appropriate timings in consideration of both a case where a treatment liquid and ink are used together in the apparatus and a case where the ink is used alone in the apparatus.

In an first aspect of the present invention, there is provided an inkjet apparatus capable of ejecting an ink and a treatment liquid for insolubilizing or coagulating a color material in the ink, the inkjet apparatus comprising:

a first acquisition unit configured to acquire first information about a consumption amount of the ink;

a second acquisition unit configured to acquire second information about a consumption amount of the treatment liquid; and a judgment unit configured to judge a replacement timing for a component constituting the inkjet apparatus on the basis of the first information and the second information, wherein the judgment unit judges the replacement timing for the component on the basis of both (a) the first and second information when the ink and the treatment liquid are consumed together and (b) the first information when the ink is consumed alone.

In another aspect of the present invention, there is provided a judging method for judging a replacement timing for a component constituting an inkjet apparatus capable of ejecting an ink and a treatment liquid for insolubilizing or coagulating a color material in the ink, the method comprising:

a first acquisition step of acquiring first information about a consumption amount of the ink;

a second acquisition step of acquiring second information about a consumption amount of the treatment liquid; and a judgment step of judging the replacement timing for the component on the basis of the first information and the second information; wherein in the judgment step, the replacement timing for the component is judged on the basis of both (a) the first and second information when the ink and the treatment liquid are consumed together and (b) the first information when the ink is consumed alone.

According to the present invention, the replacement timing for the component is judged based on both the consumption amounts of the ink and the treatment liquid measured when the two are consumed together and the consumption amount of the ink measured when the ink is consumed alone. Thus, the component is replaced at an earlier timing when the influence of fixed adhesion is great due to frequent ejection of both of the ink and treatment liquid, which prevents fixed adhesion from affecting the print performance and the printing apparatus main body. By contrast, when the fixed adhesion slowly develops because of less-frequent ejection of both of the ink and the treatment liquid, the component is replaced at a later timing and thus can be used until reaching its lifetime.

Further features of the present invention will become apparent from the following description of exemplary embodiments with reference to the attached drawings.

BRIEF DESCRIPTION OF THE DRAWINGS

FIG. 6 is an explanatory drawing showing a table referred during the process in FIG. 5;

FIG. 8 is an explanatory drawing showing a table referred during the process in FIG. 7.

DESCRIPTION OF THE EMBODIMENTS

Hereinafter, some embodiments of an inkjet apparatus of the present invention and a method for judging a replacement timing for a component constituting the apparatus will be described in detail with reference to the drawings. The present invention is widely applicable to inkjet apparatuses using media such as paper, cloth, leather, nonwoven fabric, plastic sheet, metal, and substrate. Specific application examples include printing machines such as printers, copiers, and facsimiles using an inkjet method, industrial production equipment, sprayers, and so on.

First Embodiment

Figure 1:
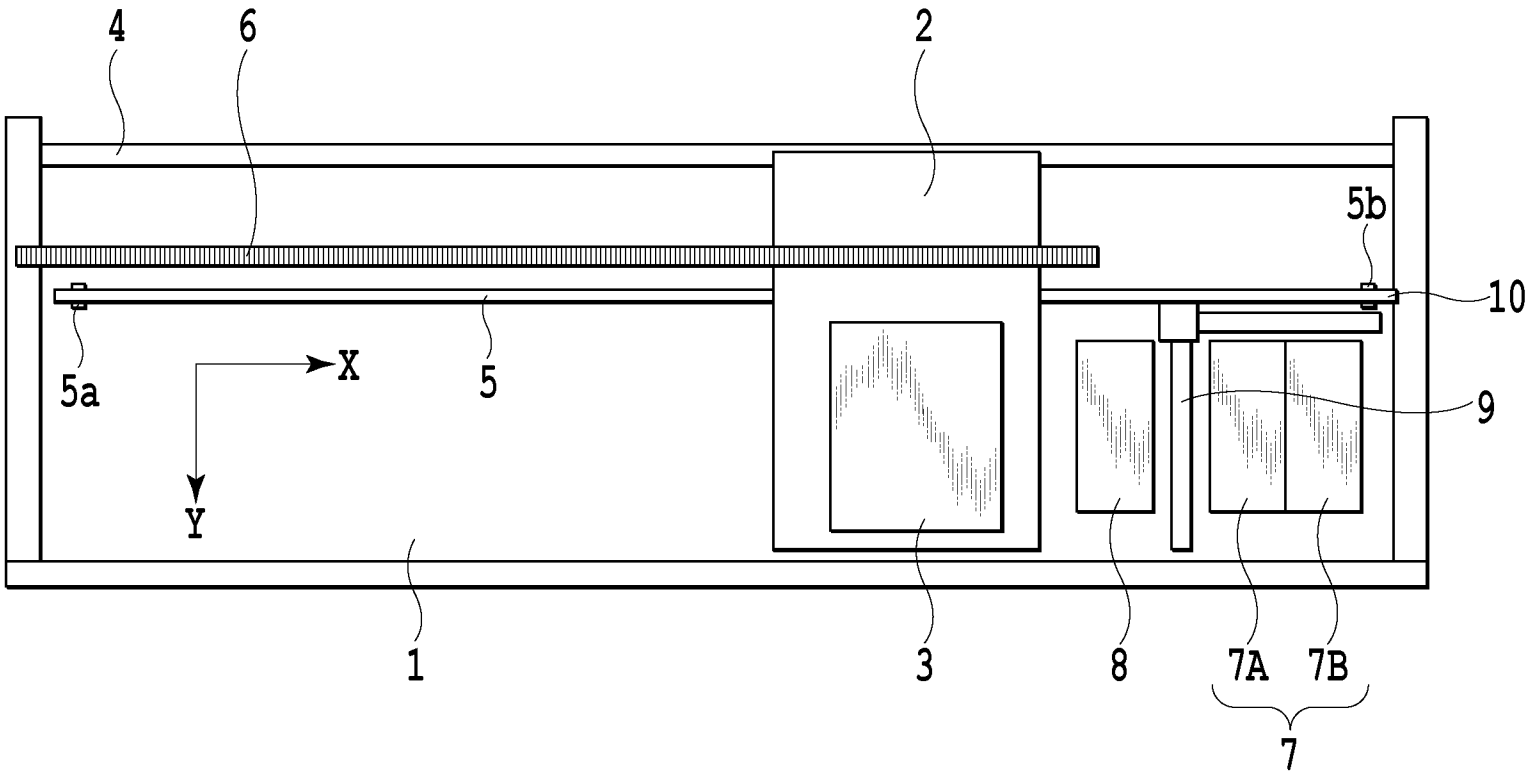
FIG. 1 is a schematic plan view showing an inkjet apparatus according to a first embodiment of the present invention.

FIG. 1 is a schematic plan view showing an inkjet apparatus according to a first embodiment of the present invention. In FIG. 1, reference numeral 1 denotes a printing apparatus main body including various mechanisms including such as a conveying unit (not shown) for a print medium. In this embodiment, the printing apparatus is a serial printing apparatus. This type of printing apparatus performs the printing operation while causing the conveying unit to intermittently convey a print medium in a Y direction and moving an inkjet head 3 in an X direction intersecting the Y direction that is a conveying direction of the print medium. Moreover, the printing apparatus main body 1 shown in FIG. 1 has a size large in the X direction so that printing can be performed on a relatively large-sized (for example, A1 size) print medium.

In addition, in FIG. 1, reference numeral 2 denotes a carriage. The inkjet head 3 is detachably mounted on the carriage 2. The carriage 2 reciprocates together with the inkjet head 3 in the X direction intersecting the conveying direction of print medium. Specifically, while movably supported along a guide shaft 4 extending in the X direction, the carriage 2 is fixed to an endless belt 5 that moves substantially parallel to the guide shaft 4. The endless belt 5 is stretched between a pair of pulleys 5*a*, 5*b* provided on both sides of the movable range of the inkjet head 3. One of the pulleys is connected to a shaft of a carriage motor (CR motor; not shown in FIG. 1). Thus, the endless belt 5 is rotated by rotation drive of the CR motor, and this allows reciprocation of the carriage 2 in the X direction.

Figure 2:
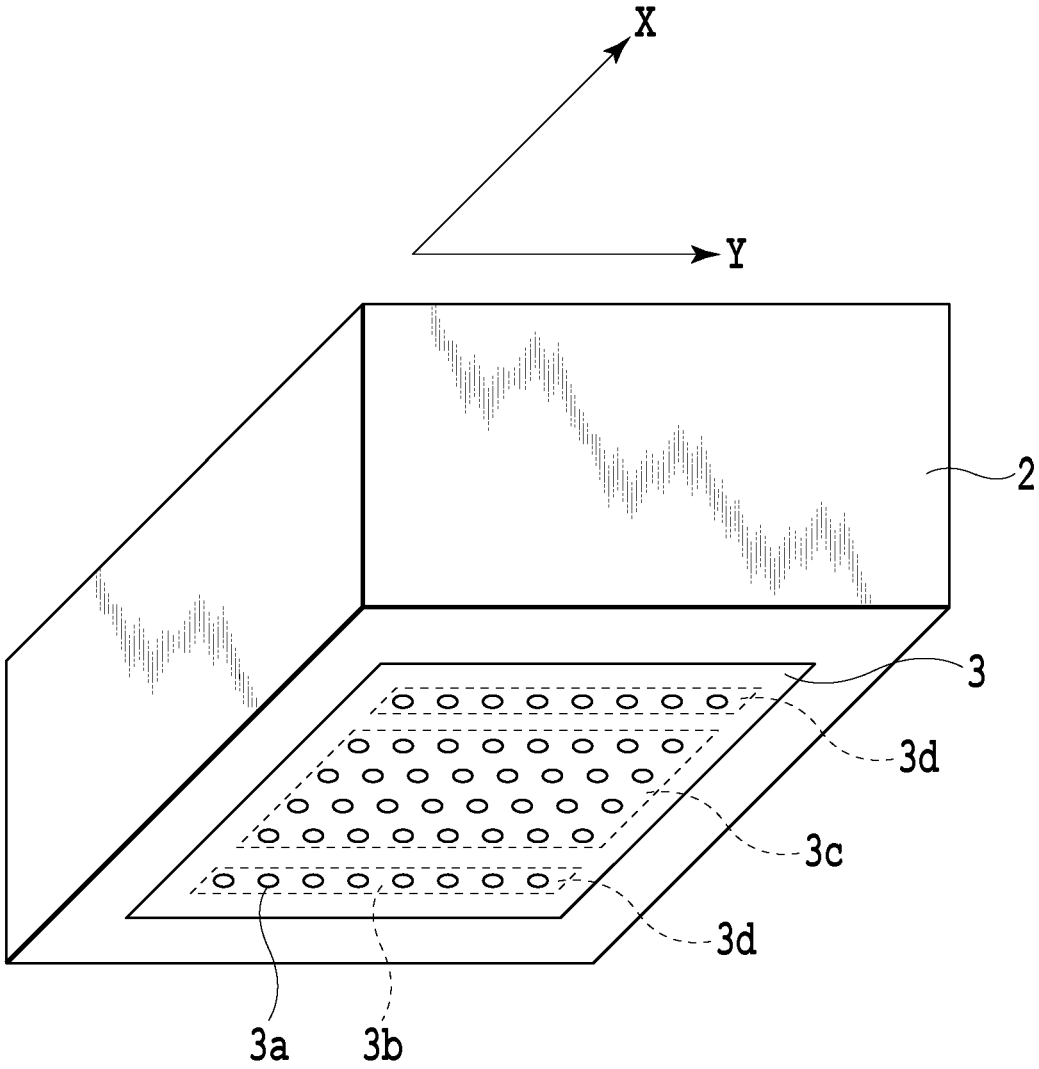
FIG. 2 is a schematic perspective view showing a configuration example of an inkjet head mounted on a carriage in FIG. 1.
Figure 3:
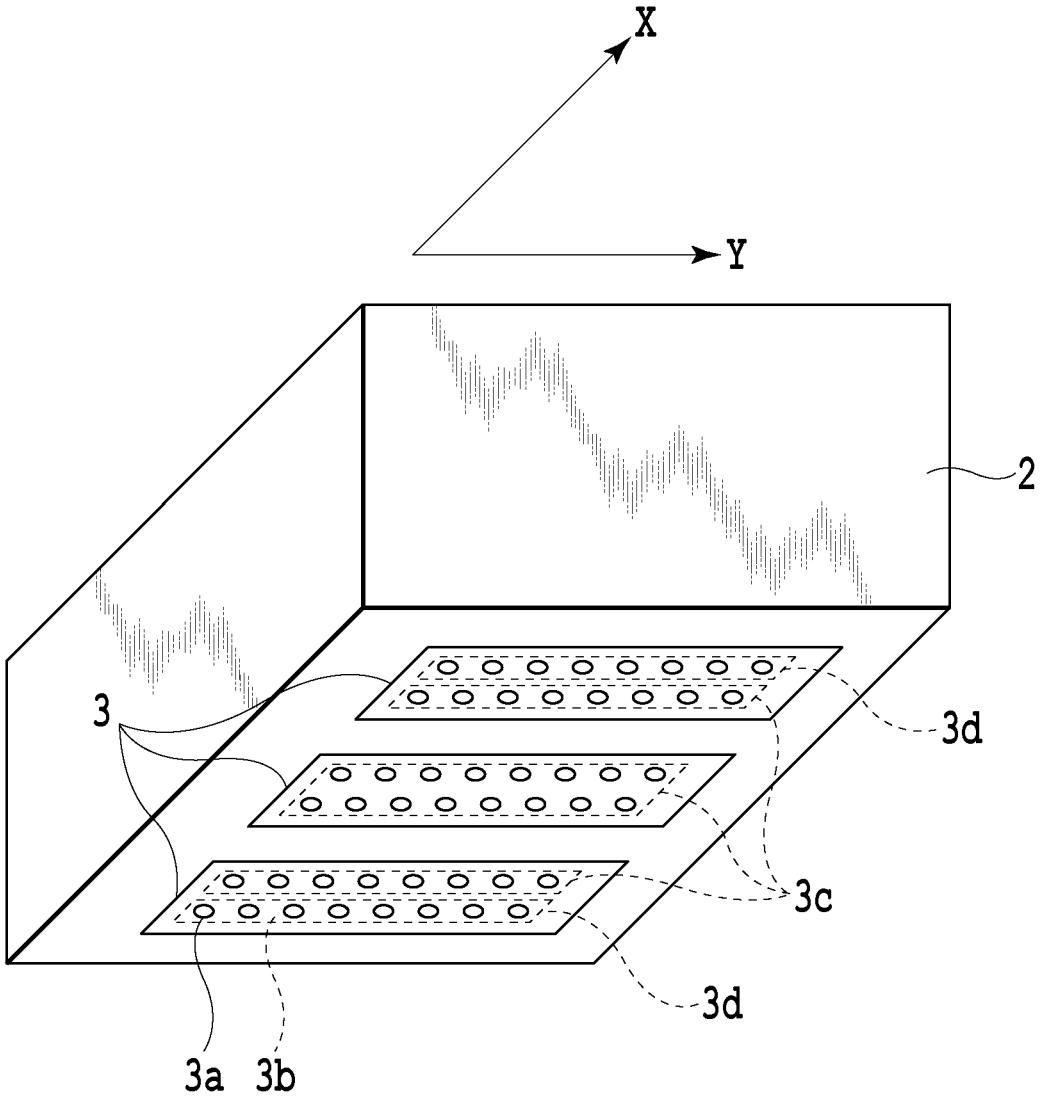
FIG. 3 is a schematic perspective view showing another configuration example of the inkjet head mounted on the carriage in FIG. 1.

FIGS. 2 and 3 are schematic perspective views showing two configuration examples of the inkjet head 3 mounted on the carriage 2. Multiple ejection openings 3*a* are formed in a face of the inkjet head 3 facing a print medium. The ejection openings 3*a* are to eject an ink or a treatment liquid for insolubilizing or coagulating color materials in the ink. Note that, hereinafter, the above face is sometimes referred to as an ejection face 3*b*. FIG. 2 shows an example in which a single inkjet head 3 is provided in the carriage 2, and FIG. 3 shows an example in which three inkjet heads 3 are integrally provided in the carriage 2. However, the inkjet head 3 to which the present invention is applicable is not limited to these.

The inkjet head 3 in any form is provided with: multiple liquid paths communicating respectively with the multiple ejection openings 3*a* for supplying the ink or the treatment liquid; a common liquid chamber communicating with the liquid paths for ink in common for storing the ink; and a common liquid chamber communicating with the liquid paths for treatment liquid in common for storing the treatment liquid. Note that, hereinafter, a combination of each of the ejection openings with the corresponding liquid path is sometimes referred to as a nozzle. Further, unless otherwise particularly distinguished, the ink and the treatment liquid are collectively referred to as a liquid. In each liquid path, an element is disposed to generate energy utilized for ejecting a liquid. The element may be, for example, an element that ejects a liquid by a pressure generated by film boiling in the liquid, the film boiling being caused by heat generated in response to electricity conducted (electrothermal transducer element). Alternatively, the element may be a piezo element that ejects a liquid by being displaced or deformed in response to application of voltage (electromechanical transducer element).

In each inkjet head 3 of this embodiment, 1280 ejection openings 3*a* are arranged for every kind of liquid (i.e., for one color ink or the treatment liquid) in the Y direction that is the conveying direction of print medium, enabling printing at a density of 1200 dpi (dots per inch). The ejection openings for ink are provided in a region 3*c* on the ejection face in FIGS. 2 and 3. The ejection openings for treatment liquid are provided on both sides of the carriage 2 in the X direction that is a moving direction of the carriage 2. Such an arrangement is made on the assumption that an image is formed on each path in a reciprocal movement of the carriage 2 (i.e., so-called bi-directional printing is performed), because it is effective to apply the ink to a print medium after the treatment liquid is applied thereto when the treatment liquid is used in image formation. Instead, the ejection openings for treatment liquid may be arranged only on one side of the carriage 2 in the X direction on the assumption that the carriage is first moved to apply the treatment liquid and is then moved to apply the ink, or that an image is formed only on any one of paths in the reciprocal movement (uni-direction printing). Further, the positions where the ejection openings for ink and the ejection openings for treatment liquid are provided can be determined as appropriate in accordance with, for example, a case where it is also effective or likely to be effective to apply the treatment liquid after the ink is applied. It is needless to say that the arrangement of the ejection openings is not limited to ones shown in FIGS. 2 and 3.

Further, the number and type of the color tone (hue, concentration) of ink used, and the kind (dye, pigment, or the like) of the color material mainly contained, can also be determined as appropriate. For example, it is possible to use four kinds of inks respectively containing color materials of cyan, magenta, yellow, and black. Each of FIGS. 2 and 3 shows a configuration provided with six arrays of the ejection openings in total: four arrays of the ejection openings for these respective four kinds of inks; and two arrays of the ejection openings for the treatment liquid. Ink tanks containing the color inks supply the inks to the common liquid chambers for the arrays of the ejection openings for color inks, respectively, and a treatment liquid tank containing the treatment liquid supplies the solution to the common liquid chamber for the arrays of the ejection openings for treatment liquid that causes coagulation by reacting with the ink. Incidentally, when it is not necessary to distinguish whether the liquid contained is the ink or the treatment liquid, these tanks are sometimes referred to simply as liquid tanks. The liquid tanks can be provided at fixed positions of the printing apparatus separately from the carriage 2, and configured to supply the liquids with tubes made of a flexible material that can follow the movement of the carriage 2. Alternatively, the liquids (inks and treatment liquid) may be supplied from liquid tanks that are provided to the carriage 2 or the inkjet head 3 in a separable or inseparable manner.

Refer to FIG. 1 again. In the printing apparatus, a recovery operation unit 7 is fixed at a predetermined position of the printing apparatus main body 1. The recovery operation unit 7 is for maintaining or recovering the condition of ejecting a liquid from each ejection opening 3*a* of the inkjet head 3 in or to a good condition. The recovery operation unit 7 includes: suction recovery mechanisms 7A, 7B; a lifting-lowering mechanism (not shown) for lifting/lowering the suction recovery mechanisms 7A, 7B; a wiping mechanism 9; and a receiving box 8.

In this example, the two suction recovery mechanisms 7A, 7B are provided, and are driven to be lifted or lowered by the lifting-lowering mechanism. Each of the suction recovery mechanisms 7A, 7B includes a cap (not shown) that is movable between a position where three arrays of the ejection openings are covered (capped) and a position that is away from the ejection face. The cap is capable of performing an operation (suction recovery operation) of forcing a liquid to be discharged by driving a pump (not shown) at the capping position to thereby exert the sucking force to the ejection unit. In other words, the suction recovery operation is an operation of forcibly sucking liquids from the multiple nozzles formed in the inkjet head to refresh the liquids in the nozzles into a condition suitable for ejection.

Moreover, the recovery operation unit 7 of this example is capable of performing preliminary ejection that is ejection of a liquid into the receiving box 8 with the inkjet head 3 facing the receiving box 8. Further, the recovery operation unit 7 of this example is provided with the wiping mechanism 9 at an end portion of the movable range of the inkjet head 3 (for example, the home position of the inkjet head). The wiping mechanism 9 is capable of moving a wiping blade 10 while sliding it on the ejection face 3*b* of the inkjet head 3. Thereby, a liquid mist, dust, and the like adhering to the ejection face 3*b* are wiped off.

Figure 4:
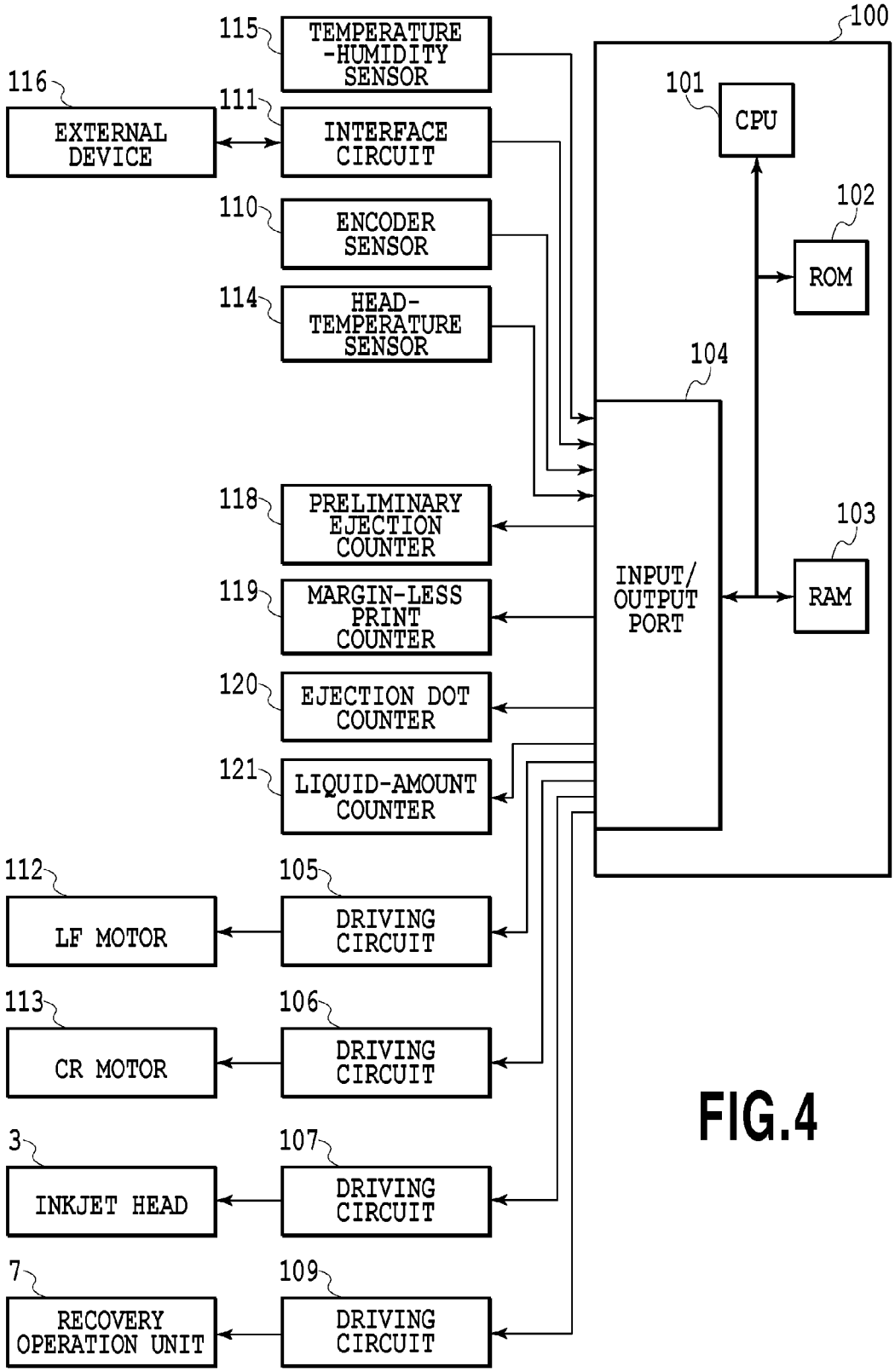
FIG. 4 is a block diagram showing a configuration of a control system used in a printing apparatus main body of the inkjet apparatus according to the embodiment of the present invention.

FIG. 4 is a block diagram showing a configuration of a control system used in the printing apparatus main body 1 of the inkjet apparatus of this embodiment. In FIG. 4, reference numeral 100 denotes a main controller that includes a CPU 101, a ROM 102, a RAM 103, an input/output port 104, and so forth. The CPU 101 executes processes such as calculation, control, determination, and setting that need to be performed in the processing procedure to be described later referring to FIG. 5. The ROM 102 stores a program corresponding to the processing procedure to be executed by the CPU 101, other fixed data, and the like. The RAM 103 is used as a buffer for storing binary print data representing ejection/non-ejection of ink, a work area for the processing by the CPU 101, and the like.

The input/output port 104 is used to transmit/receive required data between the main controller 100 or the CPU 101 and each unit to be described below. Hence, the input/output port 104 is connected to driving circuits 105, 106, 107, and 109 that respectively corresponds to a conveyance motor (LF motor) 112, a carriage motor (CR motor) 113, the inkjet head 3, and the recovery operation unit 7. Note that the LF motor 112 is a motor used as a drive source for causing the conveying unit to convey a print medium. The CR motor 113 is a motor used as a drive source for moving the carriage 2 or the inkjet head 3 over a print medium. The driving circuit 107 is a circuit for driving the inkjet head 3 in accordance with the binary print data representing ejecting/not-ejecting ink, while the inkjet head 3 is moving. Further, the driving circuit 109 is a circuit for driving the lifting-lowering mechanism for the cap, a pump activating mechanism, and the wiping mechanism in the recovery operation unit 7.

The input/output port 104 is further connected to: a head-temperature sensor 114 that is a unit for detecting the temperature of the inkjet head; an encoder sensor 110 fixed to the carriage 2; and a temperature-humidity sensor 115 that detects a temperature and humidity which are the environment conditions where the main body 1 is used. In addition to these, for example, a sensor for detecting a leading end and a trailing end of a print medium, a sensor for detecting the distance (gap) between the inkjet head and a print medium, or the like may be connected to the input/output port 104.

Moreover, the main controller 100 or the input/output port 104 is connected to an external device 116 through an interface circuit 111, which allows to transmit/receive various information such as image data to be printed, required control data, and the status of the printing apparatus main body 1. The external device 116 serves as a source of supplying print data to the printing apparatus, and has an appropriate form such as a personal computer, a scanner, and a digital camera.

The input/output port 104 is further connected to a preliminary ejection counter 118, a margin-less print counter 119, an ejection dot counter 120, and a liquid-amount counter 121. Here, the preliminary ejection counter 118 counts the number of dots ejected from the nozzle in the preliminary ejection before printing is started, after printing is completed, or during printing. The margin-less print counter 119 counts the number of ink dots ejected to a region outside a print medium, which are necessary for printing with no margin left in at least one edge portion of the print medium (i.e., margin-less printing). The ejection dot counter 120 counts the number of ink dots ejected during printing. The liquid-amount counter 121 is used for detecting a remaining amount or consumption amount of liquid in the liquid tank, and this is mainly related to a third embodiment to be described later. The liquid-amount counter 121 may have a form as a load cell that detects a remaining amount or consumption amount of liquid in each liquid tank by directly detecting the weight of the liquid tank. Alternatively, the liquid-amount counter 121 may have a form as a flow rate sensor that detects a remaining amount, a consumption amount or the like of liquid in each liquid tank by measuring a flow rate of a liquid supplied from the liquid tank. Note that it is needless to say that the ejection dot counter 120 and the liquid-amount counter 121 are updated and managed cumulatively per one replacement cycle in a process to be described later for the purpose of knowing timings of replacing components in the printing apparatus.

Next, description will be given for the outline of the printing operation executed by the inkjet apparatus having the above-described configuration. When print data is received from the external device 116 through the interface circuit 111, the print data is loaded to the buffer of the RAM 103. Then, when a printing operation is instructed, the conveying unit including the LF motor is activated, and a print medium is conveyed to a position facing the inkjet head 3. The carriage 2 is moved in the X direction along the guide shaft 4. During the movement, liquid droplets are ejected from the inkjet head 3, and an image of a band is printed on the print medium. Thereafter, the conveying unit conveys the print medium in the Y direction intersecting the moving direction of the carriage 2 by a predetermined amount (for example, by a band width corresponding to the length of the array of the ejection openings). By repeating these operations of conveying the print medium and of moving the inkjet head, an image is formed on the print medium according to the print data.

Note that the main controller 100 detects the position of the carriage 2 by counting a pulse signal which is outputted from the encoder sensor 110 along with the movement of the carriage 2. Specifically, the encoder sensor 110 detects portions to be detected which are formed at certain intervals in an encoder film 6 (see FIG. 1) disposed in the X direction. Thereby, the encoder sensor 110 outputs the pulse signal to the main controller 100. The main controller 100 counts the pulse signal, and thus detects the position of the carriage 2. The carriage 2 moves to the home position or other positions based on the signal from the encoder sensor 110.

Now, when the treatment liquid is not ejected, only the ink is ejected. Hence, the ink mist is scattered and adheres to every component within the main body, such as a recovery mechanism, a mist collecting mechanism, a liquid collecting mechanism, each sensor including the encoder sensor, and the carriage moving mechanism. The ink mist may finally become a viscous material. The viscous material accumulates on each component and consequently reduces the performance thereof. However, the degree of viscosity is smaller than that in a case where the treatment liquid is also ejected together. Meanwhile, when a treatment liquid is ejected, the treatment liquid mist and the ink mist are scattered and adhere to every component within the main body described above. The mists react with each other, and become a fixed adhesion material. In comparison with the viscous material formed of only the ink mist whose viscosity has been increased on each component with no treatment liquid ejected, such an adhesion material formed on every component within the main body in this case adheres to the components more fixedly by the reaction between the mists of the ink and the treatment liquid, thereby shortening the lifetime of each component. The fixed adhesion material accumulates on each component and reduces the performance thereof. When the components have their performance degraded and then reach their lifetimes by the accumulation of the fixed adhesion material thereon and hence the performance of the main body itself can no longer be maintained, such components have to be replaced. Additionally, when the inks and the treatment liquid discharged by the preliminary ejection or the suction recovery operation pass through the same part of the recovery mechanism and are collected into the same space of the liquid collecting mechanism, they likewise fixedly adhere to these components by the reaction, so that the function of the components can no longer be maintained.

Therefore, it is highly desirable to know how much the fixed adhesion on each of these constituent components within the main body is developed and to replace the components once the components reach their lifetimes. However, the technique disclosed in the above Japanese Patent Laid-Open No. H 11-240165 (1999) has a problem in only dealing with prevention of fixed adhesion on the inkjet head. Further, there are actually cases where printing is performed using the treatment liquid and ink together, and where printing is performed using the ink alone without the treatment liquid. Note that the latter case includes a case where the previous printing has been performed using the treatment liquid and the ink together. In this case, the printing using ink alone is performed after a time lag from the ejection of the treatment liquid in the previous printing. The influence of fixed adhesion on the inkjet head and on each component within the main body is different between the cases where printing is performed using the treatment liquid and the ink together and where printing is performed without the treatment liquid (including the case where the ink ejection is performed after a time lag from the previous ejection of the treatment liquid). However, in the technique disclosed in Japanese Patent Laid-Open No. H 11-240165 (1999) that only deals with the prevention of fixed adhesion on the inkjet head, the timing of the recovery operation is set uniform. This is because the mode and the threshold value of counting using a dot count value or a timer are the same and an appropriate distinction is not made between the cases where printing is performed using the treatment liquid and the ink together and where printing is performed without the treatment liquid. Since no countermeasure is disclosed for components within the main body in the cases where printing is performed using the treatment liquid and the ink together and where printing is performed without the treatment liquid, it naturally seems that the replacement timing for the components is invariable. Hence, when printing is performed using the treatment liquid and the ink together, the replacement timing for each component within the main body may be delayed and the performance of the main body may be insufficiently maintained in some cases. By contrast, when the ink ejection is performed after a time lag from the previous ejection of the treatment liquid, such an inconvenience that a component is replaced before reaching its lifetime may occur.

Figure 5:
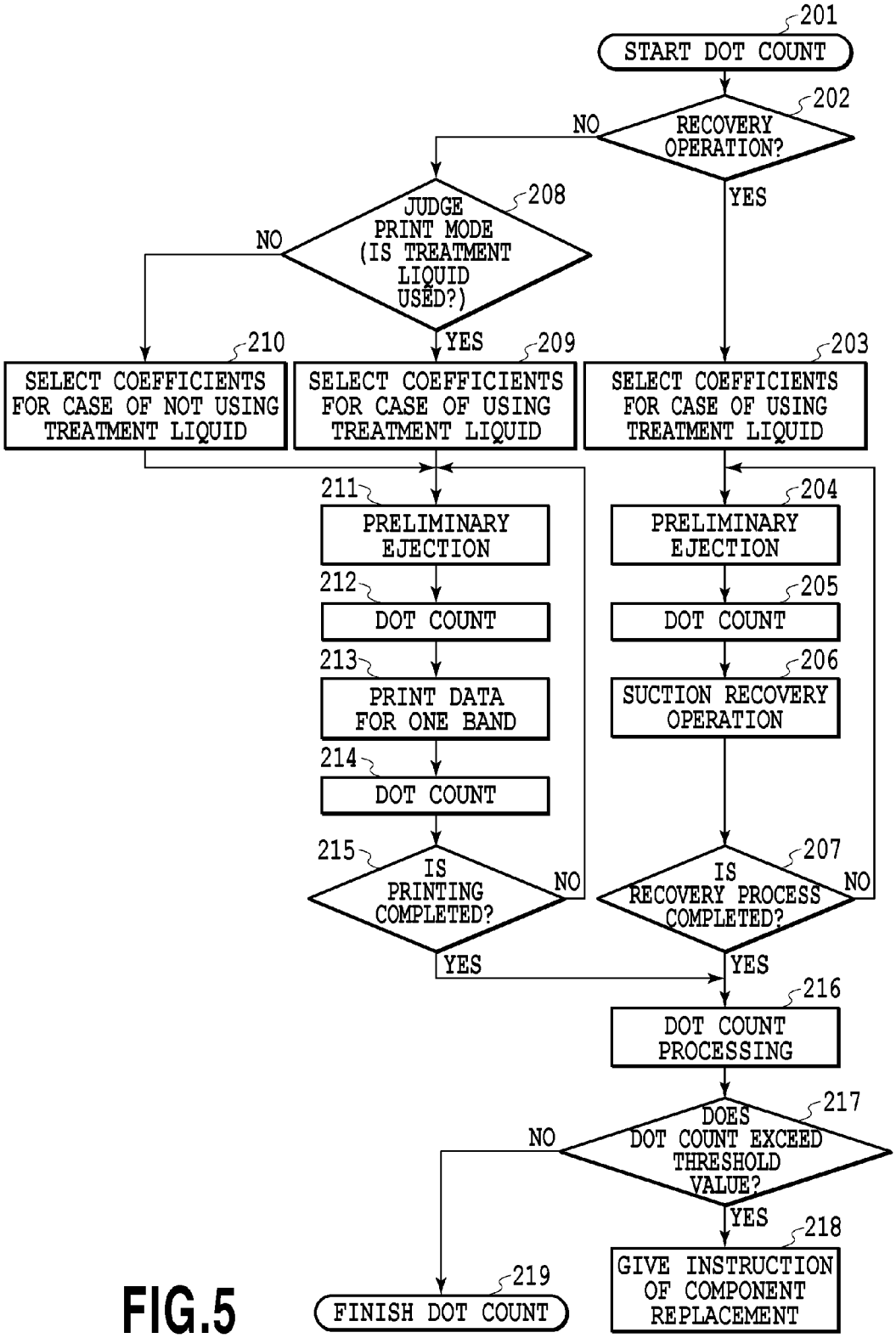
FIG. 5 is a flowchart illustrating the control procedure for notification of component replacement in the first embodiment of the present invention.

FIG. 5 illustrates an example of the processing procedure to avoid the inconvenience as described above. In this procedure, the consumption amounts of the ink and the treatment liquid are basically acquired according to the numbers of ejections of the ink and the treatment liquid (dot count value). Nevertheless, in this embodiment, for each of cases where the treatment liquid and the ink are used together and where the ink is used alone, the dot count values of the treatment liquid and the ink are weighted by multiplying the dot count values respectively by appropriate coefficients as shown in a table of FIG. 6. Then, a judgment or instruction for the replacement timing for components is made depending on whether or not the weighted dot count values exceed a predetermined threshold value. Here, the weight coefficients to be multiplied by the dot count values and the threshold value for the weighted dot count values are set individually for each component, and a judgment or instruction for the replacement timing can be made for each component independently of the other components. Note that the table data as shown in FIG. 6 may be stored as fixed data in, for example, the ROM 102.

First, the recovery operation or the printing operation is started, and dot count is started (Step 201). Next, the recovery operation or the printing operation is selected (Step 202). If the recovery operation is selected, the weight coefficients for the case of using the treatment liquid are selected (Step 203). Then, the recovery operation unit 7 causes the inkjet head 3 to perform the preliminary ejection (Step 204). The preliminary ejection counter 118 counts the number of dots in the preliminary ejection (Step 205). In this event, the dot count values of the ink and the treatment liquid are respectively multiplied by the weight coefficients for the case of using the treatment liquid shown in FIG. 6 which are selected in Step 203.

Thereafter, the recovery operation unit 7 performs the suction recovery operation (Step 206), and whether the recovery operation sequence is completed or not is judged (Step 207). If the recovery operation sequence is completed, the procedure proceeds to dot count processing (Step 216). If the recovery operation sequence is not completed, the recovery operation in Steps 204 to 206 is repeated.

Meanwhile, if the printing operation is selected in Step 202, the print mode at this time is judged (Step 208). In this example, the print mode is judged in accordance with the type of print medium on which printing is performed. Specifically, if selected is a print medium such as plain paper or coated paper for which the treatment liquid is desirably used, printing is performed with the treatment liquid. Meanwhile, if selected is a print medium such as glossy paper for which the treatment liquid does not necessarily need to be used, printing without the treatment liquid is performed. If it is judged in Step 208 that the treatment liquid is used, the weight coefficients for the case of using the treatment liquid are selected (Step 209). Meanwhile, if the treatment liquid is not used, the weight coefficients for the case of not using the treatment liquid are selected (Step 210).

Then, the inkjet head 3 performs the preliminary ejection (Step 211). The preliminary ejection counter 118 counts the number of dots in the preliminary ejection (i.e., dot count is performed) (Step 212). In this event, the dot count values of the ink and the treatment liquid are respectively multiplied by the weight coefficients selected in Step 209 or 210 for weighting. Next, after print data of one band is printed (Step 213), the ejection dot counter 120 counts the number of ejections for the print data of the one band (Step 214). In this event also, the dot count values of the ink and the treatment liquid are multiplied respectively by the weight coefficients selected in Step 209 or 210 for weighting. Then, whether or not print data of the following band exists is judged (Step 215). If the judgment is positive, Steps 211 to 214 are repeated for the print data of the following band. Meanwhile, if the judgment is negative (i.e., printing is completed), the procedure proceeds to the dot count processing (Step 216).

When the recovery operation or the printing operation as described above is completed, the dot count processing (Step 216) is performed. In this processing, the weighted dot count values of the treatment liquid and the ink ejected in the preliminary ejection during the recovery operation, or the weighted dot count values of the treatment liquid and the ink ejected in the preliminary ejection during the printing operation or in the printing, are accumulated. When the above operation is finished, whether or not the accumulated value obtained in the dot count processing exceeds a predetermined threshold value is judged (Step 217). If the accumulated value exceeds the threshold value, the user is notified of an instruction to replace the component in question (Step 218). On the other hand, if the accumulated value does not exceed the threshold value, this procedure is finished with no replacement (Step 219). Note that, in a case of giving such an instruction or notification, a display unit or sound generating unit provided in the print apparatus or in the external device can be used to present the user with information such as which component should be replaced.

Note that, in the above procedure, Steps 205, 212, and 214 constitute a first acquisition unit and a second acquisition unit for acquiring information about the consumption amounts of the ink and the treatment liquid. Moreover, in the above procedure, the order and the contents of the recovery operation are not limited to those in Steps 204 to 206. Any order and contents may be adopted, as long as the numbers of dots in the preliminary ejection can be counted and multiplied by the weight coefficients. Further, in the recovery operation (Steps 203 to 207), if the recovery operation unit 7 is capable of individually performing the recovery operations on the array 3*c* of the ejection openings for ink and on the array 3*d* of the ejection openings for treatment liquid, both the weight coefficients for the case of using the treatment liquid and the weight coefficients for the case of using no treatment liquid can be selected in Step 203. In this case, when the recovery operation is performed only on the array 3*c* of the ejection openings for the ink, the weight coefficients for the case of using no treatment liquid are selected.

Additionally, there is a print mode specifying whether printing is performed mainly focusing on the image quality or on printing speed, or the like. Whether or not the treatment liquid is used may be strongly related to the print mode. Thus, whether or not the treatment liquid is used may be determined in accordance with judgment on the image quality or printing speed, in place of or together with the above-described judgment in accordance with the type of print medium on which printing is performed. Furthermore, whether or not the treatment liquid is used may be determined directly according to the user's demand.

Second Embodiment

A second embodiment of the present invention has, in addition to the configuration of the above-described first embodiment, such a configuration that the weight coefficient further varies according to the print duty. The configurations other than this point are the same as those of the first embodiment. Accordingly, redundant description will be omitted, and description will be given only for the mode where weighting is performed differently according to the print duty.

When the number of nozzles performing ejection simultaneously is large as in high duty printing, the amount of ink mist generated is also increased. Further, a large air current is generated during the ejection. The large air current increases the amount of ink mist adhering to components within the main body, such as the recovery mechanism, the mist collecting mechanism, sensors including the encoder sensor, and the carriage.

When a treatment liquid is not used, only ink is ejected in a high duty. Thereby, a viscous material of the ink mist adheres to each component within the main body. In this case, viscosity is increased faster than in low-duty printing, thus shortening the lifetime of each component. However, the degree of viscosity on each component is smaller than that in a case where the treatment liquid is used. On the other hand, when the treatment liquid is used, the ink and the treatment liquid mix and react with each other on every component within the main body, and thereby a fixed adhesion material is formed thereon. In comparison with the viscous material formed of only ink, the fixed adhesion material formed on each component within the main body in this case adheres to the component more fixedly by the reaction between the ink and the treatment liquid, thus further shortening the lifetime of each component. Therefore, it is highly desirable to replace each component at an earlier timing when the treatment liquid is used than when the treatment liquid is not used.

Meanwhile, when the number of nozzles performing ejection simultaneously is small as in low-duty printing, the amount of ink mist generated is small. Further, an air current generated during the ejection is also small. Accordingly, a relatively small amount of ink mist adheres to components within the main body, such as the recovery mechanism, the mist collecting mechanism, sensors including the encoder sensor, and the carriage.

When the treatment liquid is not used, only the ink is ejected in a low duty. Thereby, the amount of ink mist adhering to components within the main body is small. On the other hand, when the treatment liquid is also ejected, the ink and the treatment liquid mix and react with each other on every component within the main body, and thereby a fixed adhesion material is formed thereon. Therefore, as in the high-duty printing, it is highly desirable in the low-duty printing to replace each component at an earlier timing when the treatment liquid is used than when the treatment liquid is not used.

Nevertheless, when the treatment liquid is used, the influence of an air current is greater on the high-duty printing than on the low-duty printing. Thereby, a larger number of fixed adhesion materials are formed on each component by the reaction between the treatment liquid and the ink mist, thus shortening the lifetime of the component. For this reason, a larger weight coefficient is multiplied in printing in a higher duty so that components can be replaced at an earlier timing in printing in a higher duty. The same holds for a case where the printing duty varies when the treatment liquid is not used.

As has been described above, the weight coefficient varies not only according to whether or not the treatment liquid is used as in the first embodiment, but also according to the printing duty in each case. Thus, component replacement can be more accurately instructed or notified. Note that the weight coefficient in accordance with the print duty may take continuous values, or may take discontinuous (stepwise) values in accordance with multiple stepwise duties. In addition, such weight coefficients may be tabulated as in FIG. 6, or may be obtained by calculation based on print data. Further, in a case where the ink and the treatment liquid, if used, are different in duty, each of the duty conditions may be added to the weight coefficient.

Third Embodiment

Figure 7:
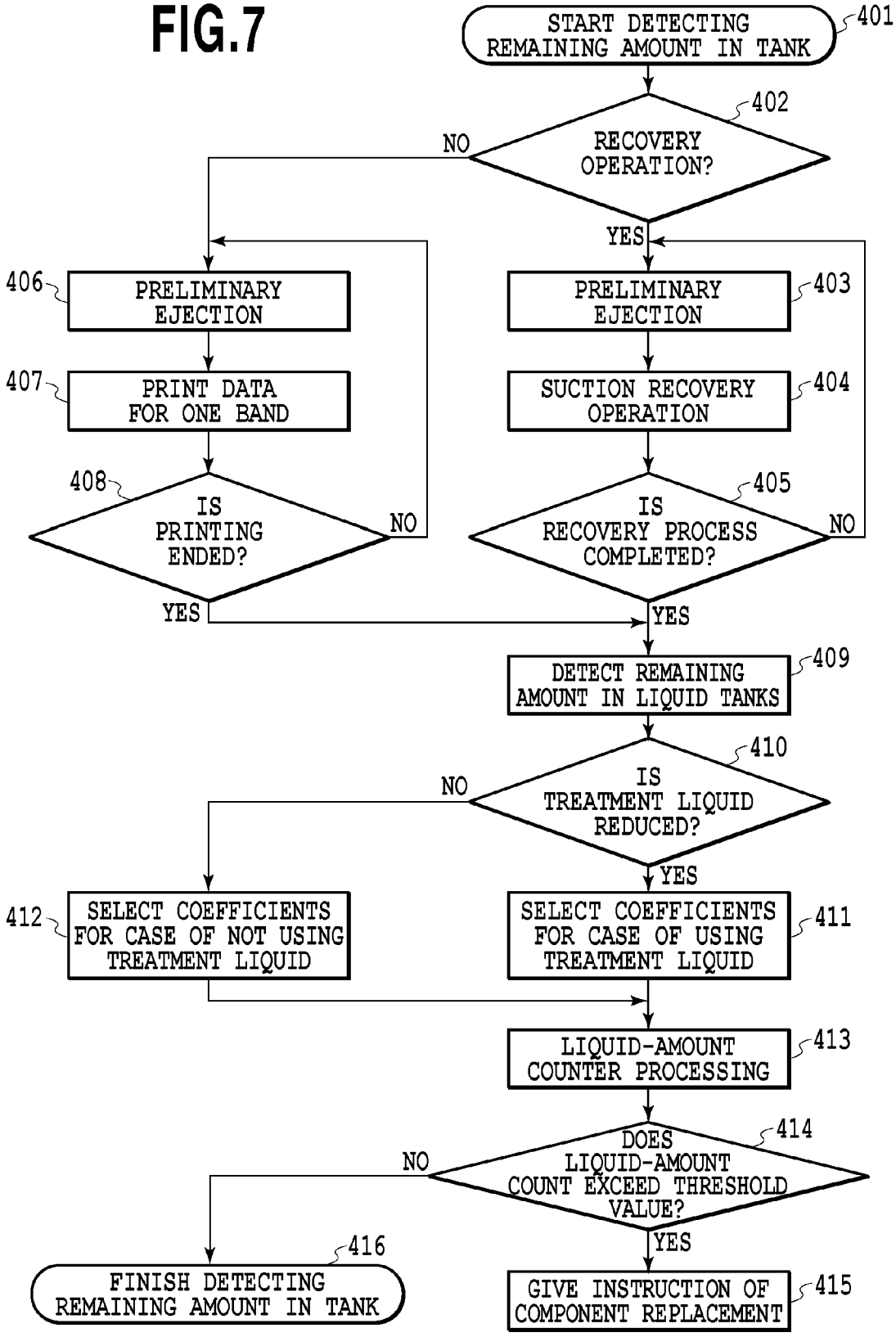
FIG. 7 is a flowchart illustrating the control procedure for notification of component replacement in a third embodiment of the present invention.

FIG. 7 shows an example of the processing procedure according to a third embodiment of the present invention. The procedure is basically performed according to a value (liquid-amount count value) detected by the liquid-amount sensor of each liquid tank. In this embodiment, for each of cases where it is detected that a treatment liquid and ink are used together for printing and where it is detected that the ink is used alone for printing, the liquid-amount count values of the treatment liquid and the ink are weighted by multiplying the liquid-amount count values respectively by appropriate coefficients as shown in FIG. 8. Then, a judgment or instruction for the replacement timing for components is made depending on whether or not the weighted liquid-amount count values exceed a predetermined threshold value. Here, the weight coefficients to be multiplied by the liquid-amount count values and the threshold value for the weighted liquid-amount count values are set individually for each component, and a judgment or instruction for the replacement timing can be made for each component independently of the other components. Moreover, the table data as shown in FIG. 8 may be stored as fixed data in, for example, the ROM 102. Note that the basic configuration and operation of the printing apparatus itself are the same as those of the first embodiment, and the description thereof will be omitted.

First, the recovery operation or the printing operation is started, and the liquid amount detection for the ink and the treatment liquid is started (Step 401). Next, the recovery operation or the printing operation is selected (Step 402). If the recovery operation is selected, the recovery operation unit 7 causes the inkjet head 3 to perform the preliminary ejection (Step 403). Subsequently, the recovery operation unit 7 causes the inkjet head 3 to perform the suction recovery operation (Step 404). Then, whether or not the recovery operation sequence is completed is judged (Step 405). If the recovery operation sequence is completed, the procedure proceeds to liquid amount detection processing on the liquid tanks (Step 409). If the recovery operation sequence is not completed, the recovery operation in Steps 403 and 404 is repeated.

On the other hand, if the printing operation is selected in Step 402, any print mode is selected, and the inkjet head 3 performs the preliminary ejection (Step 406). Incidentally, prior to this, the print mode may be judged as described above. Next, print data of one band is printed (Step 407), and whether or not print data of the following one band further exists is judged (Step 408). Here, if the judgment is positive, Steps 406 to 407 are repeated for the print data of the following one band. If the judgment is negative (i.e., printing is completed), the procedure proceeds to the liquid amount detection processing on the liquid tanks (Step 409).

When the recovery operation or the printing operation as described above is completed, the liquid amount detection processing on the liquid tanks (Step 409) is performed. The consumption amounts of the ink and the treatment liquid respectively from the ink tank and the treatment liquid tank are detected (Step 409). Thereby, whether or not the treatment liquid is consumed in the treatment liquid tank is judged (Step 410). Here, if the judgment is positive, the weight coefficients for the case of using the treatment liquid are selected (Step 411). On the other hand, if it is judged that the treatment liquid is not consumed, the weight coefficients for the case of not using the treatment liquid are selected (Step 412).

When such processes are completed, the consumption amounts of the ink and the treatment liquid in the ink tank and the treatment liquid tank are respectively multiplied by the weight coefficients selected in Step 411 or 412. Then, by the liquid-amount counter processing, weighted values of the consumption amounts of the ink and the treatment liquid from the corresponding tanks are accumulated (Step 413). When the above operation is completed, whether or not the accumulated value exceeds a predetermined threshold value is judged (Step 414). If the accumulated value exceeds the threshold value, the user is notified of an instruction to replace the component in question (Step 415). Meanwhile, if the accumulated value does not exceed the threshold value, this procedure is finished with no replacement (Step 416).

Note that the order and the contents of the recovery operation are not limited to those as in Steps 403 and 404. Any order and contents may be adopted, as long as the consumption amount of liquid in a corresponding liquid tank in the recovery operation can be detected and multiplied by the weight coefficients.

Additionally, the configuration of the liquid-amount counter 121 for detecting the amount of liquid in the liquid tank or the consumption amount of liquid from the liquid tank is not limited to one for detecting the weight of the liquid tank or the flow rate of liquid flowing out from the liquid tank. Specifically, the ejected dot counter 120 may be used in place of the liquid-amount counter 121 to calculate the consumption amount of liquid in the ejection operation by multiplying its dot count value by the amount of liquid to be ejected in a single ejection operation; moreover, to this value, the amount of liquid to be sucked per suction recovery operation may be added. Then, this added value is multiplied by the weight coefficients selected in Step 411 or 412, and the resultant value is compared with a predetermined threshold value for use in judging a replacement timing.

Others

Note that the present invention is applicable to lifetime judgment for any components which can make the performance of the printing apparatus main body unable to be maintained due to the adhesion of mist. Specifically, the present invention is applicable to at least one component included in the carriage moving mechanism, the conveying mechanism for print medium, the recovery operating mechanism, the collecting mechanism for liquid generated in the preliminary ejection and the suction recovery operation, the mechanism for collecting mist, the sensors used for printing operations, and others. In addition, the kind and number of ink as well as the numerical values such as the coefficients corresponding thereto, which are described above, are merely exemplary and any alternative can be selected as appropriate.

Moreover, the description has been given for the case where the present invention is applied to a so-called serial printing apparatus. However, it is needless to say that the present invention is applicable also to a so-called line printer-type printing apparatus that uses a print head in which ejection openings are arranged across the width of a print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-141657, filed Jun. 22, 2010, which is hereby incorporated by reference herein in its entirety.

What is claimed is:

1. An inkjet apparatus capable of ejecting an ink and a treatment liquid for insolubilizing or coagulating a color material in the ink, the inkjet apparatus comprising:

an ink tank containing the ink;

a treatment liquid tank containing the treatment liquid;

a first acquisition unit configured to acquire first information about a consumption amount of the ink;

a second acquisition unit configured to acquire second information about a consumption amount of the treatment liquid; and a judgment unit configured to judge a replacement timing of a hardware component of the inkjet apparatus on which an ink mist adheres on the basis of the first information and the second information, wherein the replacement timing of the hardware component is judged on the basis of (a) the first information and the second information, in a first operation mode where the ink and the treatment liquid are consumed together and (b) the first information in a second operation mode where the ink is consumed alone.

2. The inkjet apparatus according to claim 1, further comprising:

an instruction unit configured to give an instruction to replace the hardware component when the judgment unit judges that the replacement timing for the hardware component arrives.

3. The inkjet apparatus according to claim 1, wherein the hardware component is at least one of a component included in: a carriage moving mechanism, a conveying mechanism for print medium, a recovery operation mechanism for maintaining or recovering an ejection condition of a liquid including the ink and the treatment liquid in or to a good condition, a mechanism for collecting the liquid generated in a recovery operation, a liquid mist collecting mechanism, and a sensor used for a printing operation.

4. The inkjet apparatus according to claim 1, wherein, in the first operation mode, the first information is weighted such that the first information is multiplied by a larger coefficient than in the second operation mode.

5. An inkjet apparatus capable of ejecting an ink and a treatment liquid for insolubilizing or coagulating a color material in the ink, the inkjet apparatus comprising:

a first acquisition unit configured to acquire first information about a consumption amount of an ink;

a second acquisition unit configured to acquire second information about a consumption amount of a treatment liquid; and a judgment unit configured to judge a replacement timing of a component of the inkjet apparatus on the basis of the first information and the second information, wherein the replacement timing of the component is judged on the basis of (a) the first information and the second information, in a first operation mode where the ink and the treatment liquid are consumed together and (b) the first information in a second operation mode where the ink is consumed alone, wherein the first and second acquisition units acquire the first and second information on the basis of count values of the numbers of ejections of the ink and the treatment liquid, respectively, and in the first operation mode, the first information is weighted such that the count value of the number of ejections of the ink is multiplied by a larger coefficient than in the second operation mode.

6. The inkjet apparatus according to claim 5, wherein the first and second acquisition units multiply the count values of the numbers of ejections of the ink and the treatment liquid by larger coefficients, respectively, as the ink and the treatment liquid are ejected in a higher duty.

7. A method for determining a replacement timing of a hardware component of an inkjet apparatus capable of ejecting an ink and a treatment liquid for the ink, the method comprising the steps of:

acquiring first information about a consumption amount of the ink;

acquiring second information about a consumption amount of the treatment liquid; and determining the replacement timing of the hardware component on which an ink mist adheres, on the basis of (a) the first information and the second information, in a first operation mode where the ink and the treatment liquid are consumed together and (b) the first information in a second operation mode where the ink is consumed alone.

8. The method according to claim 7, wherein, in the first operation mode, the first information is weighted such that the first information is multiplied by a larger coefficient than in the second operation mode.

9. The method apparatus according to claim 7, wherein the hardware component is at least one of a component included in: a carriage moving mechanism, a conveying mechanism for print medium, a recovery operation mechanism for maintaining or recovering an ejection condition of a liquid including the ink and the treatment liquid in or to a good condition, a mechanism for collecting the liquid generated in a recovery operation, a liquid mist collecting mechanism, and a sensor used for a printing operation.

10. An inkjet apparatus capable of ejecting an ink and a treatment liquid for insolubilizing or coagulating a color material in the ink, the inkjet apparatus comprising:

an ink tank containing the ink;

a treatment liquid tank containing the treatment liquid;

a first acquisition unit configured to acquire first information about a consumption amount of the ink by detecting an amount of the ink contained in the ink tank;

a second acquisition unit configured to acquire second information about a consumption amount of the treatment liquid by detecting an amount of the treatment liquid contained in the treatment liquid tank; and a judgment unit configured to judge a replacement timing of a component of the inkjet apparatus on the basis of the first information and the second information, wherein the replacement timing of the component is judged on the basis of (a) the first information and the second information, in a first operation mode where the ink and the treatment liquid are consumed together and (b) the first information in a second operation mode where the ink is consumed alone, wherein, in the first operation mode, the first information is weighted such that the first information is multiplied by a larger coefficient than in the second operation mode.

* * * * *